United States Patent [19]

Chung

[11] Patent Number: 4,622,704

[45] Date of Patent: Nov. 18, 1986

[54] PORTABLE HYGENIC WARM WATER JET HAVING DISPOSABLE NOZZLE TIP

[75] Inventor: Jing-Yau Chung, Houston, Tex.

[73] Assignee: Health Jet, Inc., Houston, Tex.

[21] Appl. No.: 607,953

[22] Filed: May 7, 1984

[51] Int. Cl.[4] ..... E03D 9/08

[52] U.S. Cl. ..... 4/443; 4/420.2; 4/448; 126/344; 219/314

[58] Field of Search ..... 4/420.1, 420.2, 420.3, 4/420.4, 420, 443–449, 567; 219/314, 310, 312, 273, 297; 604/212, 213, 82–85; 126/344

[56] References Cited

U.S. PATENT DOCUMENTS

| | | | |
|---|---|---|---|
| 39,662 | 8/1863 | Lockwood | 604/213 |
| 330,083 | 11/1885 | Allen | 604/212 |
| 359,642 | 3/1887 | Spengler | 604/212 |
| 716,426 | 12/1902 | Jamison | 604/85 |
| 1,977,758 | 10/1934 | Epler | 4/420.2 |
| 2,344,561 | 3/1944 | Popil | 4/420.2 |
| 2,408,403 | 10/1946 | Babson et al. | 219/314 X |
| 2,811,156 | 10/1957 | Bragg | 604/84 |
| 2,826,761 | 3/1958 | Lazarus et al. | 4/448 X |
| 3,220,334 | 11/1965 | Martin | 219/314 |
| 3,420,411 | 1/1969 | Ronchese | 222/367 |
| 3,594,826 | 7/1971 | Maurer | 4/420.2 |
| 3,602,921 | 9/1971 | Umann | 4/448 |
| 3,662,407 | 5/1972 | Colucci | 4/420.2 |
| 3,773,047 | 11/1973 | Sneider | 604/212 |
| 3,808,608 | 5/1974 | Caplan | 4/448 |
| 3,905,370 | 9/1975 | Lazdowski | 604/212 |
| 4,062,071 | 12/1977 | Blanquet | 4/447 |
| 4,123,807 | 11/1978 | Oguma et al. | 4/420.2 |
| 4,140,104 | 2/1979 | Itagaki | 126/374 |
| 4,287,618 | 9/1981 | Silver | 4/420.2 X |
| 4,360,934 | 11/1982 | Ishigami et al. | 4/420.2 |
| 4,371,993 | 2/1983 | Patrick | 4/448 |
| 4,406,025 | 9/1983 | Huck et al. | 4/443 |
| 4,510,630 | 4/1985 | Osgood | 4/420.4 |

FOREIGN PATENT DOCUMENTS

| | | | |
|---|---|---|---|
| 0101387 | 2/1984 | European Pat. Off. | 4/420.4 |
| 3101761 | 8/1982 | Fed. Rep. of Germany | 4/420.4 |
| 911279 | 7/1946 | France | 4/448 |
| 4019 | of 1891 | United Kingdom . | |

*Primary Examiner*—Stephen Marcus
*Assistant Examiner*—Leo James Peters
*Attorney, Agent, or Firm*—Arnold, White & Durkee

[57] ABSTRACT

A portable sanitary device for cleansing the lower torso of the human body by a stream of warm water extracted from a reservoir of water heated by an electrical heating device is disclosed. The reservoir of the device comprises an enclosed lower compartment containing a heating device and a constant volume of warmed water. An upper compartment open at the top receives a supply of cold water. The upper compartment is detachable from the lower compartment to permit filling with cold water. The upper cold water reservoir contains a tubular extension which extends downward and when mounted to the sanitary device, extends to the bottom of the lower warm water reservoir. A hollow breathing tube extending from the lower compartment to the top of the upper compartment permits gravity feed of the cold water into the warm water reservoir as warm water is pumped from the lower compartment.

15 Claims, 4 Drawing Figures

Fig. 3
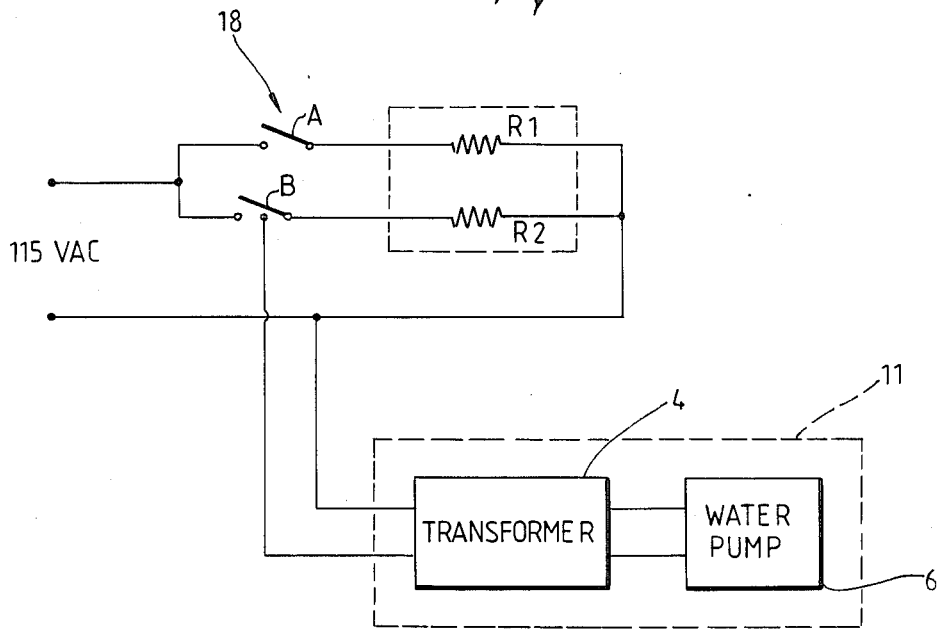
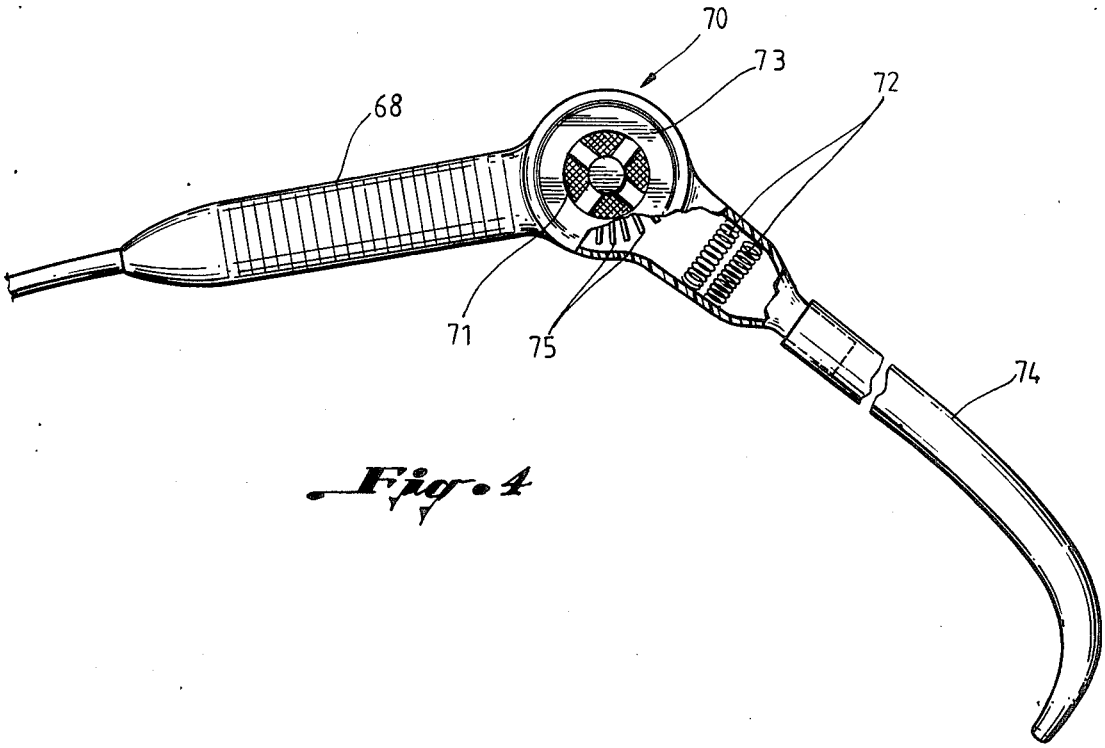
Fig. 4

PORTABLE HYGENIC WARM WATER JET HAVING DISPOSABLE NOZZLE TIP

BACKGROUND OF THE INVENTION

1. Field of the Invention

The present invention relates generally to sanitary devices commonly utilized for cleansing the anal and genital areas of the human body. More particularly, this invention relates to a portable bidet having a constant volume of warm water from which to draw for application to the lower trunk of a person, where cold water from a separate cold water reservoir gravity feeds into the warm water reservoir to replace the extracted warm water.

2. Description of the Prior Art

Hygienic cleansing devices for washing the anal and genital regions of the human body are an accepted part of ordinary personal hygiene in many parts of the world. In addition, such devices are of considerable benefit to persons suffering from hemorrhoids and other ailments of the anal-genital area.

These devices, commonly known as bidets, generally are cumbersome mechanisms requiring considerable alterations of a conventional flush toilet in order to direct the stream of warm water to the areas to be cleansed. Typically, the bidets require large amount of plumbing in order to be installed, and they tend to be complicated.

Notwithstanding their positive contribution to personal hygiene, however, bidet devices have failed to find widespread domestic acceptance in the united States and in other countries as well. Part of the reason for this has to do with the complexity and cost of installing a bidet to a conventional flush toilet with the undesirable disadvantages that the water discharge nozzle located within the toilet bowl cannot be readily reaimed during use of the device. Additionally, free-standing bidet units, which represent self-contained units, are undesirable where space is a premium because of their size. Then, too, the bidet unit represents an additional expanse which builders and buyers of new homes or apartments may not be willing to undertake, particularly when the cost of making additional permanent plumbing connections is considered.

In an effort to offer the hygienic benefits of the bidet without the inconvenience and expense involved in the installation of a free-standing bidet unit, several bidet attachments intended for use in connection with ordinary flush toilets have been proposed. For example, U.S. Pat. Nos. 3,662,407; 3,808,608; 4,360,934; and 4,406,025 disclose bidet units for use with a conventional flush toilet. Some of these bidet units disclose a spray nozzle for providing the stream of warm water as rigid elements which are placed within the toilet bowl. U.S. Pat. No. 4,406,025 discloses an arrangement by which the spray nozzle may be rotated between two positions to provide better coverage to the anal-genital area. By and large, however, these devices are characterized by a rather restricted range of positional adjustment for the spray arm, which may render them unsuitable for the needs of certain users. However, U.S. Pat. No. 3,662,407 does discloses a hand-held spray nozzle which can be directed to the parts of the body as desired.

In each of these examples of a sanitary device, none discloses a truly portable bidet arrangement which provides the access of a free ranging nozzle tip to direct the waterstream to any desired body location. U.S. Pat. No. 3,808,608 discloses what is called a portable bidet, but requires a clamping arrangement for holding the bidet nozzle tip onto the rim of the toilet bowl.

One of the primary requirements of a bidet is to deliver a stream of warm water of approximately constant temperature from the time the pump mechanism of the bidet is first actuated until its use is no longer required. This means that any water contained in the delivery means of the bidet must be maintained at a warm temperature so that the first quantity of water delivered is near the desired temperature. Elaborate mechanical arrangements to provide this function are typically required. U.S. Pat. No. 4,360,934 shows a bidet having an extendable and retractable spray arm which moves in response to the application of water pressure to the warm water tank. The water pressure forces the spray arm to extend into the toilet bowl from a cavity contained in the warm water tank. Because the spray nozzle delivery tube has been inside the warm water tank, the water within the tube will be at the proper temperature. This arrangement, of course, does not permit control of the application of the water to the body.

Another requirement of a bidet is to replenish the warm water supply so that even with repeated uses, there will always be a supply of warm water available. This requirement typically has involved plumbing the warm water tank to the cold water supply so that as water is supplied to the areas of the body to be cleaned, the water pressure permits cold water to enter the warm water chamber to mix and be heated therein. This plumbing arrangement, has, of course, prevented these bidets from having any portability. In the case of U.S. Pat. No. 3,808,608, a single water reservoir is shown for receiving cold water to be heated to the desired temperature. As this water supply is depleted, the unit must be refilled and a sufficient amount of time permitted for the heating element to bring the water temperature back to the desired temperature. Because the quantity of warm water may be completely depleted from the bidet of 3,808,608, the heating device could be damaged if the unit is powered up and the warm water in the reservoir is depleted.

Accordingly, it would be advantageous to provide a truly portable bidet unit where the volume of warm water available to the user remains constant without requiring any permanent plumbing of the water supply to the cold water pressure. It would be desirable also to provide a means to direct the spray of warm water to any part of the body as desired. Additionally, it would be advantageous to provide a portable bidet unit which provides a medicinal dispensing unit in series with the delivery of the warm water stream to permit medicines to be applied to areas of the body as desired. It would also be advantageous to enhance the hygienic quality of the portable bidet by providing disposable nozzle tips to enable more than one user to use the device without contamination to one another.

SUMMARY OF THE INVENTION

In accordance with the present invention a portable bidet device is disclosed. The bidet includes a detachable cold water reservoir for receiving a quantity of cold water which functions to replenish the warm water extracted from the bidet and applied to the body. The cold water reservoir includes a tubular cold water passageway which extends downward from the bottom of the reservoir. Contained within the tubular cold water passageway is a stopper means having movement from a first position where the tubular passageway is closed permitting the cold water reservoir to be filled, to a second position when the cold water reservoir is mounted on the bidet with the passageway open permitting cold water to gravity feed into the bottom of a warm water reservoir as the stream of warm water is supplied to the body.

Also included is a completely enclosed warm water reservoir adapted to receive the cold water reservoir thereon. The warm water reservoir contains a heating device for heating the water and an opening in the top of the reservoir that is adapted to sealably receive therethrough the tubular cold water passageway when the cold water reservoir is mounted onto the warm water reservoir. The inserted tubular cold water passageway extends to the bottom of the warm water reservoir. This permits mixing of the incoming cold water with the warm water beginning at the bottom of the reservoir.

Further included is a breathing tube which extends from the hot water reservoir to a point near the top of the cold water reservoir. This breathing tube permits warm water from the warm water reservoir to rise up the tube and seek the same water level as the water in the cold water reservoir. The breathing tube and the tubular cold water passageway cooperate together to permit cold water to gravity feed into the warm water reservoir through the passageway as warm water is extracted from the warm water reservoir.

A delivery means is provided for extracting warm water from the top of the warm water reservoir and delivering a stream of such water to the body for cleansing and medicinal purposes. This warm water delivery means includes a flexible hose connected between the top of the warm water reservoir and the input side of a pump. A nozzle is connected to the output side of the pump for delivering the stream of warm water to the body. In accordance with one embodiment of the invention, the pump is an electrical pump. The pump could also be a hand-actuated pump or could include a tandem arrangement of both an electrical pump and a hand-actuated pump.

The present invention further includes a dispensing means coupled between the pump and the nozzle, and is responsive to the passage of warm water therethrough for dispensing medicines for delivery to the body with the warm water stream. The present invention also includes disposable nozzle tips covering the nozzle end. These disposable nozzle tips have an opening therethrough to permit the stream of water from the nozzle to be applied to the body. The nozzle is adapted to securely receive a disposable nozzle tip thereon.

The present invention also includes a covered storage compartment for receiving therein the deliverey means when not in use so that heat from the heating device warming the water in the warm water reservoir also warms the delivery means and any water that might be contained therein. A warm air blower is also provided for drying the parts of the body after cleansing with the warm water stream.

In a different aspect of the present invention, a portable sanitary device for cleansing the lower torso of the body by a stream of water extracted from a reservoir of warm water heated by an electrical heating device is disclosed. The reservoir of the sanitary device comprises an enclosed lower compartment containing the heating device and completely filled with water. An upper compartment open at the top receives a supply of cold water. The upper and lower compartments are divided by a surface having a tubular extension extending downward to the bottom of said lower compartment. This tubular extension permits warm water to gravity feed from the upper to the lower compartment. A hollow breathing tube is provided that extends from the lower compartment to the top of the upper compartment. Warm water from the lower compartment may rise in the breathing tube to seek the same water level as the water in the upper cold water compartment. The breathing tube and the tubular extension cooperate to permit cold water in the upper compartment to gravity feed into the bottom of the lower compartment as warm water is pumped from the lower compartment.

BRIEF DESCRIPTION OF THE DRAWINGS

For a fuller understanding of the invention reference should be had to the following detailed description taken in conjunction with the drawings in which:

FIG. 3 is an electrical circuit diagram of the control circuits for the heating device and the water pump as illustrated in FIG. 1; and FIG. 4 is an illustration of the hand-held warm air blower for drying the portions of the body cleansed by the warm water stream.

Similar reference numerals refer to similar parts throughout the several views of the drawings.

DETAILED DESCRIPTION OF THE PREFERRED EMBODIMENT OF THE INVENTION

Figures 1, 2:
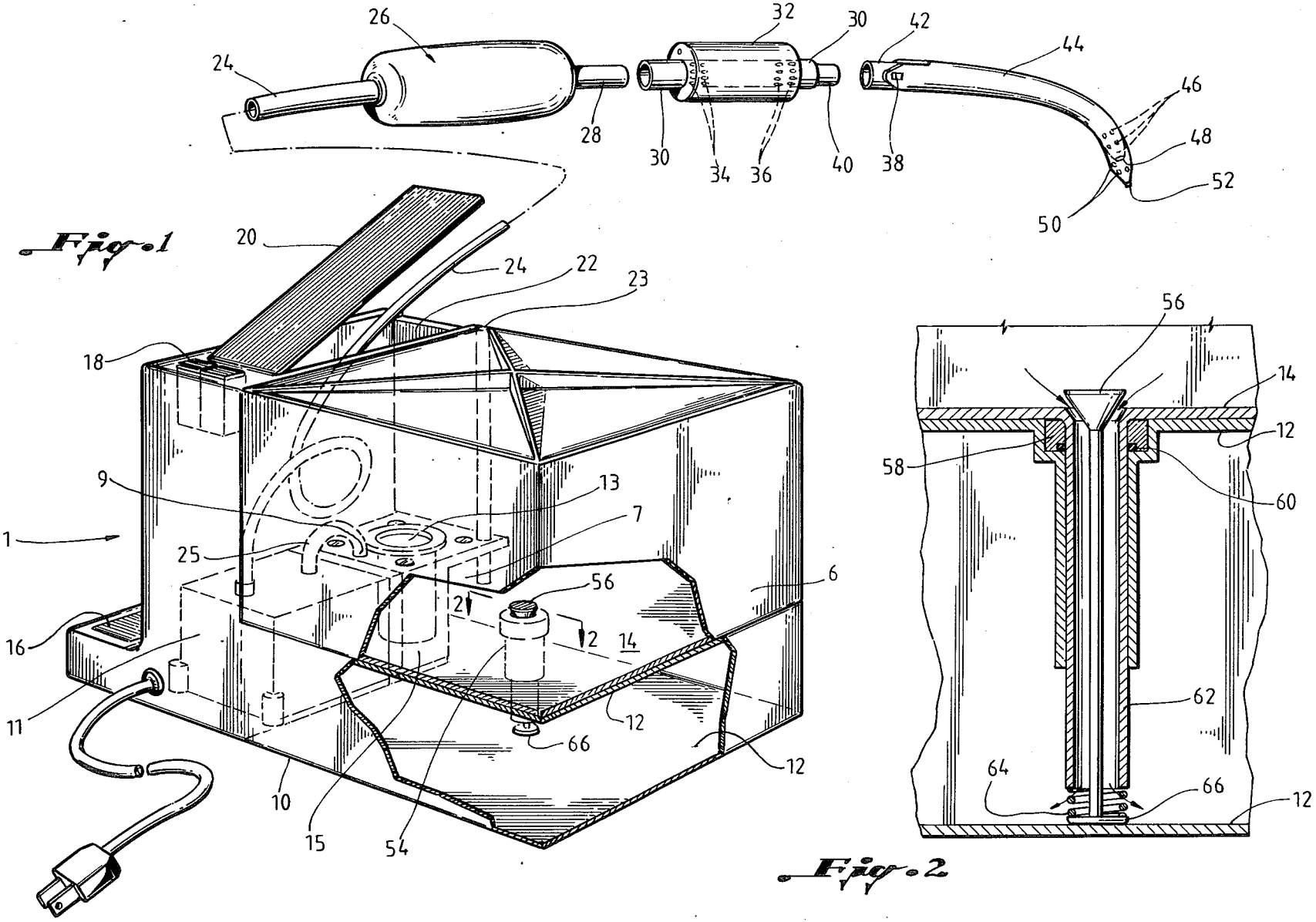
FIG. 1 is an illustration of the preferred embodiment of the present invention.
FIG. 2 is an illustration of the valve mechanism between a detachable upper cold water reservoir and an enclosed lower warm water reservoir.

Referring now to the figures and first to FIG. 1, there is shown the portable sanitary device 1 in accordance with the preferred embodiment of the present invention. The bidet 1 is comprised of an upper cold water reservoir 14 that is positioned above a lower warm water reservoir 12. In one aspect of the invention, the upper cold water reservoir 14 is detachable from the bidet 1 to permit filling of the reservoir with cold water from any appropriate source, such as the bathroom sink. In another aspect of the invention, the cold water reservoir 14 is constructed integral with the lower warm water reservoir 12. For this latter embodiment, a surface 6 divides the upper cold water reservoir 14 from the lower warm water reservoir 12. Accordingly, the valve means 54 shown in FIG. 1, and in more detail in FIG. 2, is not required in this alternate embodiment. The valve means 54 is required when the upper cold water reservoir 14 is detachable from the bidet unit 1.

In either embodiment, the cold water from the cold water reservoir 14 is allowed to gravity feed through a tubular cold water passageway into the bottom of the warm water reservoir 12 as warm water is extracted from within the warm water reservoir 12 during use of the bidet. In order to permit this gravity feed of the cold water from the upper compartment to the lower compartment, a breathing tube 23 is provided from the warm water reservoir 12 to a point near the top of the cold water reservoir 14 when such reservoir is mounted onto the bidet 1.

The breathing tube 23 is opened to the atmosphere at the top, and at the bottom, to the warm water in the lower warm water reservoir 12. In this way, the warm water from the compartment 12 is permitted to rise up the breathing tube 23 and seek the same level as the water level in the cold water reservoir. In this manner, air pressure is equalized between the two reservoirs so that as warm water is extracted from within the lower completely enclosed warm water reservoir 12 by a pump means during use of the portable bidet, cold water can fall through the valve means 54 into the bottom of the lower warm water reservoir 12.

As the cold water enters the warm water chamber 12, mixing begins at the bottom and progresses upward to the top of the warm water reservoir 12. In the process, some of the cooler water passes by the heating device 13 to be heated to the desired temperature. In the embodiment shown in FIG. 1, the heating device 13 is positioned in one corner of the warm water container. This position for the heating device is not critical and just as well could have been placed near the bottom of the reservoir next to the tip of the cold water passageway 62 (see FIG. 2).

Extraction of the warm water for delivery to the nozzle portion of the bidet is taken from a point 9 at the top of the warm water reservoir 12. In this manner, the amount or volume of warm water contained in the lower warm water reservoir 12 remains constant regardless of whether there is a further supply of cold water in the upper cold water reservoir 14. When the cold water reservoir 14 is empty, the pump is no longer able to remove water from the warm water reservoir so the lower warm water reservoir 12 never becomes empty. This has a significant safety advantage in that the heating element will always have a volume of water to heat and should not burn out its heating element, as can happen if there is not a sufficient amount of heat sink around the heating device.

Still referring to FIG. 1, the heating device 13 which, for example, could be the Westbend Company heating element No. 29360, is shown located in one corner of the lower warm water reservoir 12. A partition surface 15 defines one wall of the lower warm water reservoir 12, but has an opening 7 therein into a further chamber of the warm water reservoir wherein the heating device 13 is located. The volume of water defined in this enclosed area permits the heating device to maintain the water in that area to a relatively constant temperature as the cold water begins to mix upon entering the bottom of the warm water reservoir 12.

In an alternate embodiment of the invention, a different type of heating device from the electrical heating device 13 shown in FIG. 1 could be used, such as the well-known Coleman propane-gas stove used in outdoor cooking (not shown in FIG. 1). This heating device would be external to the warm water reservoir 12 and provide heating energy to the reservoir from beneath. With such an arrangement, the portable bidet of the present invention would be self sufficient of any need for electrical or water plumbing connections. The hand-actuated squeeze pump 26 could provide the stream of warm water which is heated by the propane gas heating device.

An electrical pump 11 which, for example, could be the pump as used in the "clean water machine" as manufactured by Norelco Company, is shown positioned adjacent to the electrical heating device 13 with a section of flexible hose 25 connecting the upper part of the warm water reservoir 12 with the input side of the electrical pump. In this manner, as the electrical pump 11 is actuated, water will be drawn into the pump from the warm water reservoir 12 from the top near the electrical heating device 13.

Connected to the output side of the electrical pump 11 is a section of flexible hose 24 which connects to the input side of a hand-actuated squeeze pump 26 which, for example, could be the well-known hand-actuated squeeze pump used in priming an outboard motor from a fuel tank. With this arrangement, the pumping action can either be as a result of the actuation of the electrical water pump or by squeezing of the hand-actuated pump 26. Either pump may be provided in preference to the other or provided as a tandem arrangement. On the output side of the hand-actuated pump 26 will be the nozzle 44. In one embodiment of the invention, a medicinal dispensing means 32 could also be provided between the output side of the hand-actuated pump 26 and the nozzle 42.

Still referring to FIG. 1, the medicinal dispensing means 32 is shown as a tube 30 with a plurality of openings 34, 36 contained therein. Surrounding the central portion of tube 30 is a cylindrical enclosure which defines an annular region 31 for receiving medicines. The openings 34, 36 are also contained in such annular region 31. The openings 34, 36 permit a portion of the warm water passing through the tube 30 to the nozzle 42 to enter the annular region 31 through the openings 34. In this manner, medicine which has been inserted into this annular region can mix with the warm water and pass through the openings 36 back into the stream of warm water flowing to the nozzle 42.

The coupling together of the various elements in the warm water delivery means comprised of the water pump 11, hand-actuated pump 26, medicinal dispensing means 32, and the nozzle 42 is by friction fit of the plastic tubing. In this manner, there is no need for any clamping means in order to secure the various elements in the tandem arrangement. For example, tube 30 which passes through the medicinal dispensing means 32 contains a smaller tube element 40 at its output end which fits within the inner diameter of the nozzle 42 as the nozzle tip is slipped thereon. The end of the tube 30 butts against the nozzle tip 42 when the medicinal dispenser 32 is fully inserted into the nozzle. In a similar arrangement, the tube 28 extending from the output side of the hand-actuated pump 26 slips inside the input side of tube 30 of the medicinal dispenser 32, or into the nozzle 42 if the medicinal dispensing means 32 is not present.

Still referring to FIG. 1, one of the outstanding features of the present invention is the utilization of disposable flexible nozzle tips 44 to further increase the sanitary features of the present invention. The nozzle 42 is provided with a nipple 38 which hooks into a similarly shaped hole cut in the disposable tips 44 to securely receive the disposable nozzle tips 44 when placed over the nozzle 42. The nozzle 42 is curved and can contain a plurality of openings 46 or a single opening 48 at the tip. Depending upon the particular application, a nozzle 42 could be selected with or without the orifices 46. Similarly, the disposable nozzle tips can contain a plurality of openings 50 or a single opening 52. With the single opening 52 a single stream of warm water can be delivered to the portions of the body desired. With the disposable tip arrangement, it is possible, in addition to the sanitary cleansing operations, to provide enema type applications. The disposable nature of the nozzle tips ensures sanitary uses of the portable bidet 1.

One of the essential features of a bidet is to be sure that the initial surge of water delivered to the body is at the proper temperature to avoid a discomfort factor. To accomplish this function, the bidet 1 of the present invention includes a compartment 22 which is covered by lid 20 when the delivery means, including the flexible tube 24, hand-actuated pump 26, and nozzle elements 42, 44 are contained therein. The heat from the heating device 13 will warm the compartment 22 and any water that may be contained in the delivery means so that water will be at the proper temperature, or at least at a comfortably warm level.

To actuate the bidet 1, a set of suitable electrical switches 18 are provided to select the various modes of operations for the bidet. These modes of operations are more fully discussed with reference to FIG. 3 below.

Because the bidet 1 of the present invention can have different applications, from strictly sanitary cleansing operations to the application of medicines and the application of medical treatment, a compartment 16 is provided to store various shaped and size nozzle tips along with a supply of disposable tips.

Turning now to FIG. 2, there is shown a more detailed view of the valve means 54 shown in FIG. 1. When the upper cold water reservoir 14 is of the detachable kind, the arrangement of FIG. 2 results. The cold water reservoir 14 contains a tubular cold water passageway 62 which extends downward from the bottom of the cold water reservoir 14. When the cold water reservoir 14 is inserted onto the lower warm water reservoir 12, the tubular passageway 62 is received within a passageway contained in the upper surface of the warm water reservoir 12. The warm water reservoir 12 contains an opening 8 in the top surface defined by downward extension 60. The opening in reservoir 12 is adapted to receive the cold water passageway 62 of the cold water reservoir 14 as shown in FIG. 2. An O-ring seal 60 is provided in the opening to seal around the outer surface of the tubular cold water passageway 62 when it is installed. A packing 58 is provided to secure O-ring seal 60 in the opening 8. This prevents water from the warm water reservoir 12 from leaking out due to the higher water column that is now present in the lower warm water reservoir 12.

In order to permit the falling of the cold water reservoir 14, a water stopper means 56 is provided in the cold water passageway 62. The stopper means 56 assumes a first position in which the cold water passageway 62 is closed when the cold water reservoir 14 is detached from the bidet 1. When the cold water reservoir 14 is placed onto the bidet 1 and the tubular passageway 62 is inserted in the opening 8 in the upper wall of the warm water tank 12, the stopper mechanism is moved to a second position which permits the gravity feed of cold water through the cold water passageway 62 into the bottom portion of the lower warm water reservoir 12. A spring 64 may be included with the stopper means 56 to insure that when the cold water reservoir 14 is detached from the bidet 1, the stopper has sealed the cold water passageway. While a tubular configuration for the cold water reservoir 62 is shown in FIG. 2, it should be appreciated by those skilled in the art that a passageway of a different shape is possible, the tubular shape for the passageway and O-ring providing a convenient means for sealing against the loss of warm water.

In an alternate embodiment of the invention, the upper cold water reservoir 14 and the lower warm water reservoir 12 are constructed as a single integral piece. The upper cold water reservoir 14 is not detachable from the bidet 1. In this configuration, there is no need for the sealing O-ring 60 or the stopper means 56 as shown in FIG. 2. In this arrangement, a dividing wall, such as wall 6 shown in FIG. 1, with a tubular cold water passageway extending from the cold water reservoir 14 down to the bottom of the lower warm water reservoir 12 is provided.

Turning now to FIG. 3, there is shown the electrical circuit diagram for connecting both the heating device 13 and the water pump 11 to the AC outlet. The electrical switches 18 are shown as a four-way switch having the following four possible settings. With switches A and B both "open" the bidet 1 is powered down, both the heater and the pump. If switch A is closed, the low temperature preheat with pump off mode of operation is selected. If switch A is open and switch B is closed, the medium temperature heating mode with pump on mode is selected. With both switch A and switch B closed, the high temperature heating mode with pump on mode is selected.

Still referring to FIG. 3, the closure of switch B applies power to the transformer 4 that in turn provides voltage to a water pump 6 that together comprise the water pump 11 as shown in FIG. 1.

Turning now to FIG. 4 there is shown a hand-held dryer unit 70 which can be included with the present invention to dry the portions of the body cleansed by the warm water stream. A handle 68 is provided for controlling the direction of application of the heated air provided by the blower arrangement 73. Air is drawn into the blower through air inlets 71 and directed across heating element 72 and into a nozzle tip 74. The principles of operation are well-known for such a device and a detail description will not be provided. A ratchet type of arrangement 75 is provided to index various angles for the nozzle tip 74 relative to the blower 70.

Although the present invention has been described with reference to a preferred embodiment, it will be understood that the invention is not limited to the details thereof. Many substitutions and modifications, a few of which have been noted in the foregoing detailed description, may be made without departing from the spirit and scope of the invention as defined in the appended claims.

I claim:

1. A portable bidet comprising:

(a) a cold water reservoir for receiving a quantity of cold water, said cold water reservoir having a tubular cold water passageway extending from the bottom thereof;

(b) an enclosed warm water reservoir adapted to detachably receive said cold water reservoir thereon, said warm water reservoir having, (i) a heating device for heating the water contained therein, and (ii) an opening in the top of said reservoir adapted to sealably receive therethrough said tubular cold water passageway, (iii) said inserted tubular cold water passageway extending to a point near the bottom of said warm water reservoir to permit mixing of the incoming cold water with the warm water beginning at the bottom;

(c) a breathing tube extending from said hot water reservoir to a point proximal the top of said cold water reservoir, said breathing tube permitting warm water to rise up said tube to seek the same water level as the level in said cold water reservoir, said breathing tube and said tubular cold water passageway cooperating together to permit cold water to gravity feed into said warm water reservoir through said passageway as warm water is extracted from said warm water reservoir; and (d) a delivery means for extracting warm water from the top of said warm water reservoir and delivering a stream of such water to the body for cleansing or medicinal purposes.

2. The bidet of claim 1 wherein said warm water delivery means comprises:

(a) a flexible hose connected to the top of said warm water reservoir for the passage of warm water therethrough;

(b) a pump having an input and output side with the input side connected to the opposite end of said hose for extracting warm water from said warm water reservoir; and (c) a nozzle coupled to the output side of said pump for delivering the stream of warm water to the body.

3. The bidet of claim 2 wherein said pump is an electrical pump.

4. The bidet of claim 2 wherein said pump is a hand-actuated pump.

5. The bidet of claim 2 wherein said pump includes both an electrical pump and a hand-actuated pump.

6. The bidet of claims 2 or 5 wherein said delivery means further includes dispensing means coupled to said pump and said nozzle, and responsive to the passage of warm water therethrough for dispensing medicines for delivery to the body with the warm water stream.

7. The bidet of claim 6, wherein said dispensing means comprises:

a tube adapted to communicate said stream of water, having a plurality of openings in the wall of said tube; and a cylindrical enclosure surrounding said tube, defining an annular region for receiving and mixing medicines.

8. The bidet of claim 2 further including disposable nozzle tips covering said nozzle, said disposable nozzle tips having an opening therethrough to permit the stream of water from said nozzle to be applied to the body, said nozzle adapted to securely receive a disposable nozzle tip thereon.

9. The bidet of claim 1 further including a covered storage compartment for receiving therein said delivery means when not in use so that heat from said heating device can warm said delivery means and any water contained therein.

10. The bidet of claim 9 further including means for storing various shaped nozzles and nozzle tips.

11. The bidet of claim 9 further including a warm air blower for drying the parts of the body after cleansing with the warm water stream.

12. The bidet of claim 1 wherein said tubular cold water passageway contains a stopper means therein having movement from a first position where said tubular passageway is closed permitting said cold water reservoir to be filled, to a second position when mounted on said warm water reservoir with said passageway open permitting cold water to gravity feed into the bottom of said warm water reservoir.

13. A portable bidet comprising:

(a) a cold water reservoir for receiving a quantity of cold water, said cold water reservoir having a tubular cold water passageway extending from the bottom thereof;

(b) an enclosed water water reservoir adapted to detachably receive said cold water reservoir thereon, said warm water reservoir having, (i) a heating device for heating the water contained therein, and (ii) an opening in the top of said reservoir adapted to sealably receive therethrough said tubular cold water passageway, (iii) said inserted tubular cold water passageway extending to a point near the bottom of said warm water reservoir to permit mixing of the incoming cold water with the warm water beginning at the bottom;

(c) a stopper means contained in said tubular cold water passageway, having movement from a first position where said tubular passageway is closed permitting said cold water reservoir to be filled, to a second position when mounted on said warm water reservoir with said passageway open permitting cold water to gravity feed into the bottom of said warm water reservoir;

(d) a breathing tube extending from said hot water reservoir to a point proximal the top of said cold water reservoir, said breathing tube opening to the atmosphere to permit warm water to rise up said tube to seek the same water level as the level in said cold water reservoir, said breathing tube and said tubular cold water passageway cooperating together to permit cold water to gravity feed into said warm water reservoir through said passageway as warm water is extracted from said warm water reservoir; and (e) a delivery means for extracting warm water from the top of said warm water reservoir and delivering a stream of such water to the body for cleansing or medicinal purposes.

14. A portable bidet comprising:

(a) a detachable cold water reservoir for receiving a quantity of cold water, said cold water reservoir having a tubular cold water passageway extending from the bottom thereof;

(b) an enclosed warm water reservoir adapted to receive said cold water reservoir thereon, said warm water reservoir having, (i) a heated device for heating the water contained therein, and (ii) an opening in the top of said reservoir adapted to sealably receive therethrough said tubular cold water passageway, (iii) said inserted tubular cold water passageway extending to a point near the bottom of said warm water reservoir to permit mixing of the incoming cold water with the warm water beginning at the bottom;

(c) a stopper means contained in said tubular cold water passageway, having movement from a first position where said tubular passageway is closed permitting said cold water reservoir to be filled, to a second position when mounted on said warm water reservoir with said passageway open permitting cold water to gravity feed into the bottom of said warm water reservoir;

(d) a breathing tube extending from said hot water reservoir to a point proximal the top of said cold water reservoir, said breathing tube permitting warm water to rise up said tube to seek the same water level as the level in said cold water reservoir, said breathing tube and said tubular cold water passageway cooperating together to permit cold water to gravity feed into said warm water reservoir through said passageway as warm water is extracted from said warm water reservoir; and (e) a delivery means for extracting warm water from the top of said warm water reservoir and delivering a stream of such water to the body for cleansing or medicinal purposes.

15. A portable sanitary device for cleansing the lower torso of the body by a stream of warm water extracted from a reservoir of water heated by an electrical heating device, said reservoir of said sanitary device comprising:

(a) an enclosed lower compartment completely fillable with water for heating by said heating device;

(b) an upper compartment, open at the top, detachable from said lower compartment, for receiving a supply of cold water;

(c) a tubular extension extending downward from the lower surface of said upper compartment, said upper and lower compartments divided by said surface, said tubular extension extending downward to the bottom of said lower compartment, permitting cold water to pass from said upper to said lower compartment, said lower compartment having a separate top portion having an opening therethrough for sealably receiving said tubular extension from said surface when said upper compartment is mounted on said lower compartment; and (d) a hollow breathing tube extending from said lower compartment to the top of said upper compartment, for receiving warm water therein from said lower compartment, said breathing tube and said tubular extension cooperating to permit cold water in said upper compartment to gravity feed into the bottom of said lower compartment as warm water is pumped from said lower compartment.

* * * * *